US006369496B1

(12) United States Patent
Yoshiki

(10) Patent No.: US 6,369,496 B1
(45) Date of Patent: Apr. 9, 2002

(54) MICRO COLD CATHODE WITH SHIELD MEMBER

(75) Inventor: Masayuki Yoshiki, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/203,325

(22) Filed: Dec. 2, 1998

(30) Foreign Application Priority Data

Dec. 3, 1997 (JP) ..... 9-332984

(51) Int. Cl.[7] ..... H01J 1/304; H01J 19/24
(52) U.S. Cl. ..... 313/309; 313/336; 313/351
(58) Field of Search ..... 313/309, 310, 313/351, 336; 445/24

(56) References Cited

U.S. PATENT DOCUMENTS

| | | | | | |
|---|---|---|---|---|---|
| 5,394,006 | A | * | 2/1995 | Liu | 313/310 |
| 5,442,193 | A | * | 8/1995 | Jaskie et al. | 313/309 |
| 5,739,628 | A | * | 4/1998 | Takada | 313/309 |
| 5,831,378 | A | * | 11/1998 | Rolfson et al. | 313/336 |
| 6,022,256 | A | * | 2/2000 | Rolfson | 445/24 |
| 6,194,829 | B1 | * | 2/2001 | Lu | 313/336 |

FOREIGN PATENT DOCUMENTS

| | | | |
|---|---|---|---|
| JP | 5-242797 | 9/1993 | H01J/9/02 |
| JP | 7-14499 | 1/1995 | H01J/1/30 |
| JP | 7-240143 | 9/1995 | H01J/1/30 |
| JP | 8-321255 | 12/1996 | H01J/1/30 |
| JP | 8-329824 | 12/1996 | H01J/1/30 |
| JP | 8-148080 | 6/1997 | H01J/1/30 |

OTHER PUBLICATIONS

Japanese Office Action, dated Aug. 29, 2000, with an English language translation of the Japanese Examiner's comments.
Japanese Office Action, dated Jun. 27, 2001, with English language translation of Japanese Examiner's comments.

* cited by examiner

*Primary Examiner*—Michael H. Day
(74) *Attorney, Agent, or Firm*—Whitham, Curtis& Christofferson

(57) ABSTRACT

On a substrate 1 having at least one conductive surface are formed an insulating film 2 and a conductive gate film 3. In a predetermined area, an opening reaching the substrate 1 is formed and a conical emitter electrode is formed in the opening. A shield member 13 is formed, which spatially shields at least part of the insulating film 7 from the emitter electrode.

6 Claims, 5 Drawing Sheets

MICRO COLD CATHODE WITH SHIELD MEMBER

SPECIFICATION

BACKGROUND OF THE INVENTION

1. Field of the Invention

This invention relates to a micro cold cathode which may be used as an electron beam source for a variety of electron beam devices such as a flat panel display and a CRT.

2. Description of the Related Art

Recently, a field emission type of cold cathode has been intensively studied and developed, in which a conductive substrate, an insulating layer, a gate electrode layer and a cathode emitter with a sharp tip within the openings thereof may be formed as an integrated part using a semiconductor fine processing technology. Such a cathode is expected to be applied to a high-performance electron gun.

A typical example of a manufacturing technique for a conventional field emission type of cold cathode may be a Spindt-type cold cathode, whose manufacturing process is shown in FIG. 5.

First, on a silicon substrate 1 are sequentially deposited a silicon oxide film 2 and a gate film 3(FIG. 5(*a*)), and after forming a resist 4, a circular opening is formed via etching (FIG. 5(*b*)). Then, a sacrificing layer 5 consisting of aluminum is formed by oblique vapor deposition, rotating the substrate(FIG. 5(*c*)). After forming the sacrificing layer 5, an emitter material is deposited from a vertical direction to the substrate by means of an appropriate procedure such as a vapor deposition technique under a high vacuum. As the emitter material is deposited, the emitter material is gradually condensed around the opening of the sacrificing layer, leading to reduction of the opening diameter and then blockage of the opening. At the same time, a conical emitter is formed on the conductive substrate(FIG. 5(*d*)). Finally, the sacrificing layer 5 and the emitter material layer 6 deposited thereon are simultaneously etched off to give a cold cathode (FIG. 5(*e*)).

A process for manufacturing a silicon cold cathode will be described by referring to FIG. 6. First, a silicon mask 20 is formed on a predetermined region of a silicon substrate(FIG. 6(*a*)). The substrate is then subject to isotropic etching(FIG. 6(*b*)) and then oxidation to form a conical emitter(FIG. 6(*c*)). Then, a silicon oxide film 2 and a gate film 3 are sequentially deposited on the whole surface of the substrate (FIG. 6(*d*)). Finally, the silicon oxide film 2 is etched off to give a cold cathode(FIG. 6(*e*)).

The cold cathode with either of the above structures, however, has a problem that during its use and/or voltage of application, the conical emitter may be sputtered by suspended metal particles and/or ion bombardment, resulting in adhesion of a conductive film on the side of the insulating film (silicon oxide film). Thus, current leak may occur between the emitter and the gate, leading to destruction of the cold cathode.

Hence, JP-A 8-321255 has suggested the following structure for ensuring insulation between an emitter and a gate.

FIG. 3 shows an example, where an insulating layer is etched for keeping the side of the insulating film away from the opening for the emitter and the gate, to avoid adhesion of, for example, suspended metal particles on the side of the insulating film.

FIG. 4 shows another example, where two types of insulating films with different etching rates during formation of the insulating film, i.e., the first and the second insulating films 10, 11, are alternately formed, which provides a corrugated shape after etching. It intends to increase a creeping distance on the side face for preventing current leak.

These cold-cathode structures for preventing current leak, however, cannot adequately prevent current leak. Thus, for adequately preventing the leak, it is necessary to increase the etching amount of the insulating film in the transverse direction. However, it may cause increase of a pitch between emitters in an emitter array, leading to decrease of a current density.

SUMMARY OF THE INVENTION

This invention for solving the above problems provides a micro cold cathode comprising a substrate having at least one conductive surface, an insulating film formed thereon and a conductive gate film formed thereon, in which there is formed an opening reaching the substrate in the insulating film and the conductive gate film and an emitter electrode is formed in the opening, wherein there is provided a shield member which spatially shields at least part of the insulating film from the emitter electrode.

This invention further provides a micro cold cathode comprising a substrate having at least one conductive surface, an insulating film formed thereon and a conductive gate film formed thereon, in which there is formed an opening reaching the substrate in the insulating film and the conductive gate film and an emitter electrode is formed in the opening, wherein there is provided a shield member which spatially shields at least part of the insulating film from metal particles emitted from the emitter electrode during voltage application.

The cold cathode of this invention has a shield member between the side of the insulating film and the conical emitter to spatially shield at least part of the insulating film from the emitter electrode. Thus, it can effectively prevent, for example metal particles from the emitter electrode from adhering to the side of the insulating film, which may cause forming a conductive film on the side, and thus can prevent current leak. Here, the shield member may be a wall or step formed between the emitter electrode and the insulating film.

This invention further provides a process for manufacturing the above micro cold cathode having a shield member between the emitter electrode and the insulating film, comprising the steps of;

(a) forming the first insulating film on a silicon substrate, and then a groove on the first insulating film;

(b) forming the second insulating film on the upper face of the first insulating film, filling the groove;

(c) forming a gate film on the second insulating film;

(d) forming an opening reaching the substrate so that the sides of the first insulating film, the second insulating film and the gate film are exposed; depositing a sacrificing layer around the opening from an oblique direction; depositing an emitter material to form a conical emitter; and then etching the sacrificing layer off; and (e) wet-etching the first and the second insulating films to form a wall around the emitter. In the above step (c), a silicon nitride film may be formed between the second insulating film and the gate film. It may allow a creeping distance to be increased and thus may prevent leak between the lower surface of the gate film and the substrate.

This invention further provides a process for manufacturing the above micro cold cathode having a shield member between the emitter electrode and the insulating film, comprising the steps of;

(a) forming a nitride film and the first insulating film on a substrate, applying a photoresist to the region of the nitride and the first insulating film, and then forming a mask for emitter formation by etching the nitride and the first insulating films using the photoresist;

(b) forming a cylindrical structure by etching the silicon substrate using the mask for emitter formation;

(c) oxidizing the substrate to form a narrowed region in the center part of the cylindrical structure by means of a silicon oxide film;

(d) conducting silicon-oxide anisotropic etching and silicon anisotropic etching using the nitride film as a mask to form a silicon cylindrical structure below the narrowed region, leaving the silicon oxide film under the nitride film;

(e) oxidizing the silicon cylindrical structure until the silicon part is divided into two subparts at the narrowed region;

(f) etching off the nitride film and the silicon subpart above the narrowed region, and then forming a groove on the first insulating film;

(g) forming the second insulating film on the upper face of the first insulating film, filling the groove;

(h) etching off the gate film and the third insulating film to expose the side of the gate film; and (i) dry-etching the silicon nitride film and wet-etching the second and the first insulating films, to expose the emitter tip and form a step of the first insulating film.

According to the process for manufacturing a micro cold cathode of this invention, a shield member can be suitably provided around the emitter electrode, utilizing a groove formed on the first insulating film.

In the above process of this invention, it is preferable that the first insulating film has a lower etching rate during wet-etching than that of the second insulating film because it allows a wall or step to be readily formed. Typical combinations of the first and the second insulating films include thermal oxide and HTO(High Temperature Oxide) films, as well as silicon nitride and silicon oxide films, respectively.

As described above, the micro cold cathode of this invention has a wall or step between the side of the insulating film and the conical emitter to effectively prevent a conductive film from being deposited on the side of the insulating film and thus to effectively prevent current leak.

DETAILED DESCRIPTION OF THE PREFERRED EMBODIMENTS

Figure 1A:
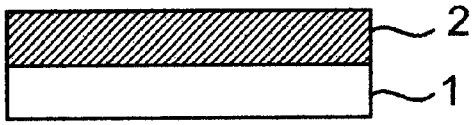
FIG. 1 illustrates a manufacturing process for a micro cold cathode according to this invention.
Figure 1B:
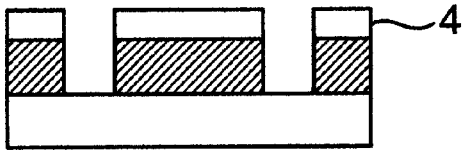
Figure 1C:
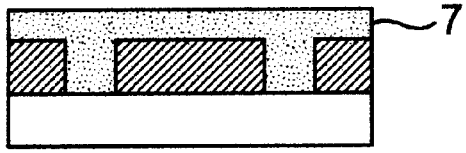
Figure 1D:
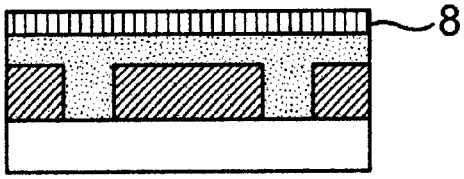
Figure 1E:
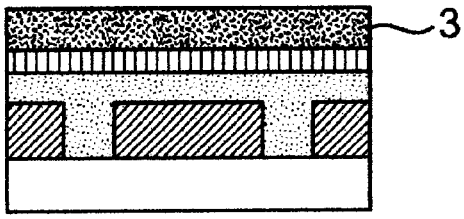
Figure 1F:
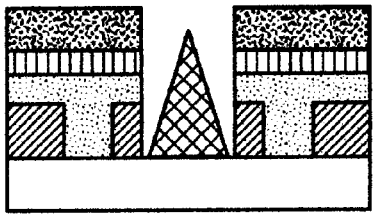
Figure 1G:
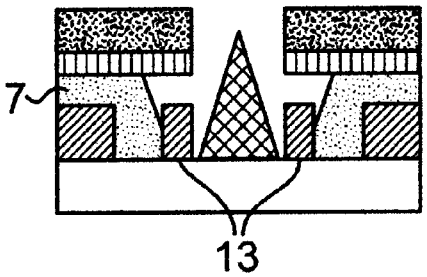
Figure 2A:
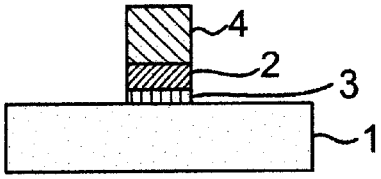
FIG. 2 illustrates another manufacturing process for a micro cold cathode according to this invention.
Figure 2B:
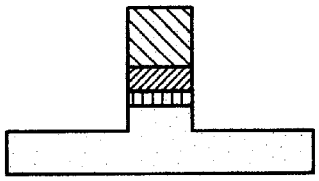
Figure 2C:
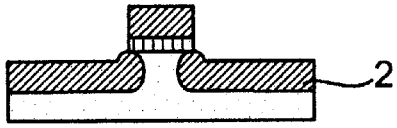
Figure 2D:
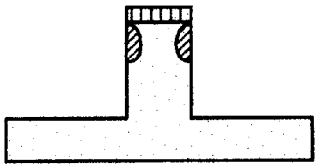
Figure 2E:
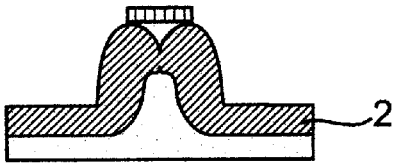
Figure 2F:
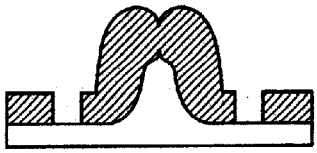
Figure 2G:
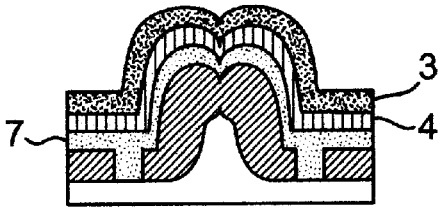
Figure 2H:
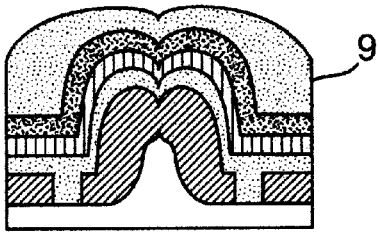
Figure 2I:
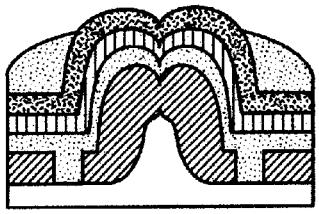
Figure 2J:
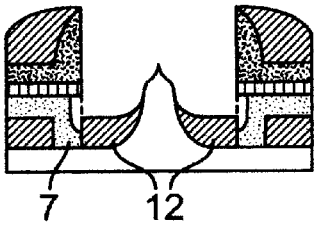
Figure 3:
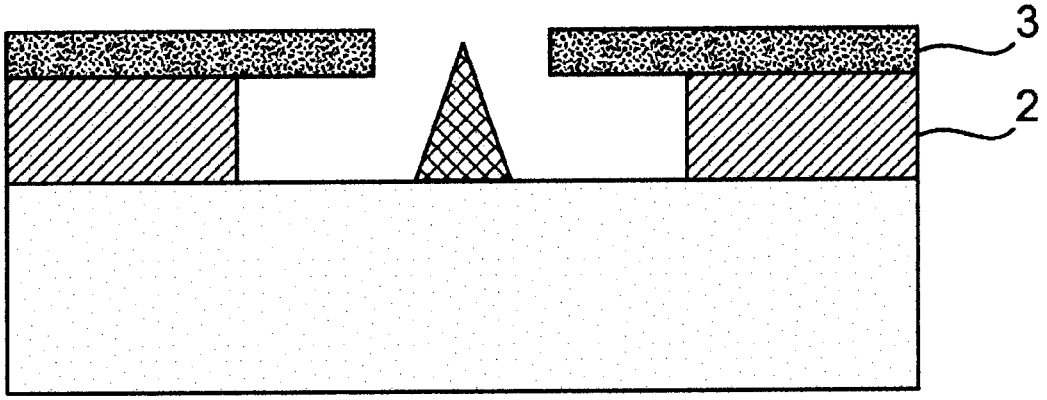
FIG. 3 PRIOR ART
FIG. 3 shows a cross-sectional structure of a micro cold cathode according to the prior art.
Figure 4:
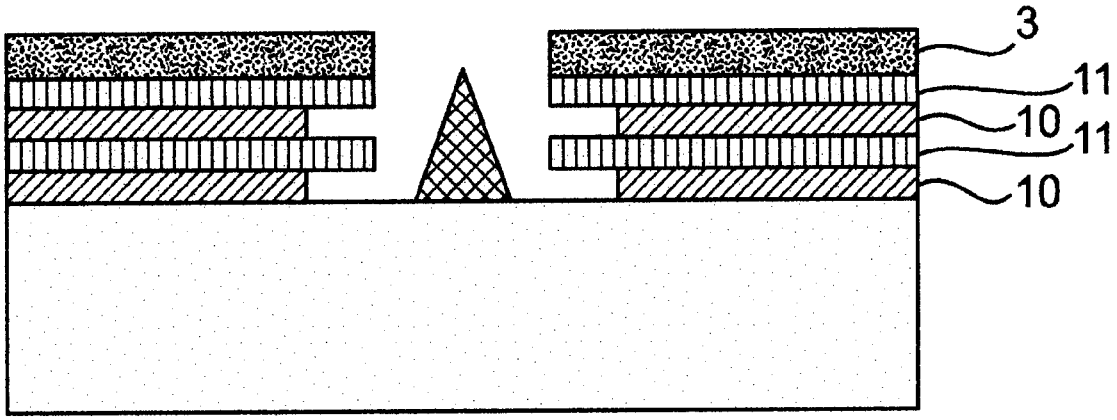
FIG. 4 PRIOR ART
FIG. 4 shows a cross-sectional structure of another micro cold cathode according to the prior art.
Figure 5A:
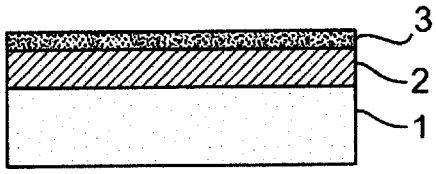
FIG. 5a PRIOR ART
FIG. 5 illustrates a manufacturing process for a micro cold cathode according to the prior art.
Figure 5B:
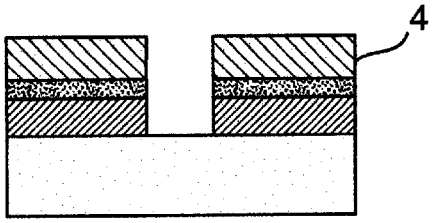
FIG. 5b PRIOR ART
Figure 5C:
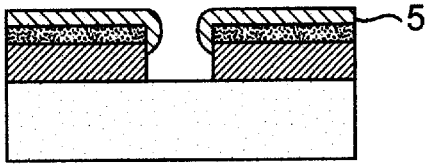
FIG. 5c PRIOR ART
Figure 5D:
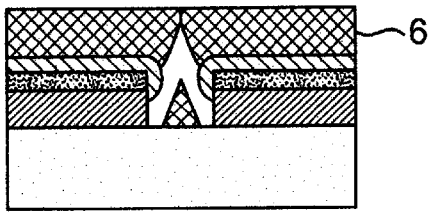
FIG. 5d PRIOR ART
Figure 5E:
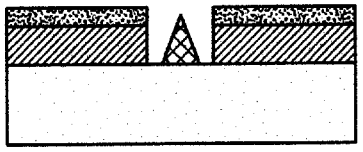
FIG. 5e PRIOR ART
Figure 6A:
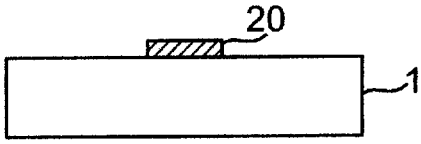
FIG. 6a PRIOR ART
FIG. 6 illustrates another manufacturing process for a micro cold cathode according to the prior art.
Figure 6B:
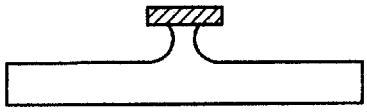
FIG. 6b PRIOR ART
Figure 6C:
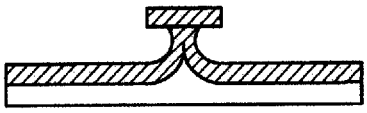
FIG. 6c PRIOR ART
Figure 6D:
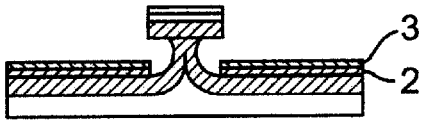
FIG. 6d PRIOR ART
Figure 6E:
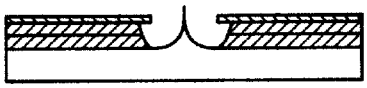
FIG. 6e PRIOR ART

A shield member in this invention is formed between an emitter electrode and an insulating film, to spatially shield the insulating film from the emitter electrode, i.e., from metal particles emitted from the emitter electrode. Specifically, it maybe a wall 13 in FIG. 1(*g*) or a step 12 in FIG. 2(*j*) formed between an emitter electrode and an insulating film. Such a shield member, e.g., the shield member 13, permits that at least part of the side of the insulating film, i.e., the insulating film 7 in FIGS. 1(*g*) and 2(*j*), is shielded, to prevent, for example, metal particles from adhering to the insulating film. The shield member generally consists of an insulator; otherwise, it may impair the functions of the cold cathode.

Examples of this invention will be described by referring to the drawings.

EXAMPLE 1

This example will be described by referring to FIG. 1. First, on a silicon substrate 1 is formed a silicon oxide film 2 with a thickness of 3000 Å as the first insulating film by a thermal oxidation technique (FIG. 1(*a*)). Using a resist 4, in the silicon oxide film 2 is formed an annular groove with an outer diameter 12000 Å and an inner diameter 8000 Å, as shown in FIG. 1(*b*) which illustrates the cross section of the annular groove. Then, the annular groove is filled with the second insulating film (high temperature oxide (HTO) film) 7 and the surface is smoothed (FIG. 1(*c*)). On the surface are formed a silicon nitride film 8 (FIG. 1(*d*)) and then a gate film 3 consisting of WSi (FIG. 1(*e*)). of 5000 Å reaching the silicon substrate is formed, a sacrificing layer 5 is vapor-deposited from an oblique direction and then an emitter material is vapor-deposited, to form a conical emitter(FIG. 1(*f*)). The sacrificing layer 5 is etched off. Then, the HTO film 7 is etched by about 5000 Å from the inner wall of the opening by oxide-film wet-etching, while the thermal oxide film 2 is etched only by 1000 Å. Thus, a cold cathode structure having a wall, i.e., the shield member 13, around the emitter is provided due to the difference of their etching rates, as shown in FIG. 1(*g*).

In the cold cathode with such a structure, the wall (step 13) consisting of the thermal oxide film around the emitter plays a role as a wall for disconnecting a leak path of metal particles generated during spattering the conical emitter, and thus can effectively prevent current leak between the emitter and the gate.

EXAMPLE 2

This example will be described by referring to FIG. 2. On a predetermined region of a silicon substrate are formed a nitride silicon film 8 with a thickness of 800 Å and a silicon oxide film 2 with a thickness of 5000 Å, and then a resist 4 with a diameter of 5000 Å as a circular mask for emitter formation(FIG. 2(*a*)). The silicon substrate is etched by 3000 Å to form a silicon cylindrical structure (FIG. 2(*b*)). Then, a silicon oxide film 2 with a thickness of 2500 Å is formed by oxidation to form a narrowed region in the center part of the cylindrical structure(FIG. 2(*c*)). Then, the silicon oxide film 2 is anisotropically etched by 2600 Å and the silicon substrate is anisotropically etched by 4000 Å, to form another silicon cylindrical structure under the narrowed region. The oxide film 2 is grown by thermal oxidation to form a structure in which the silicon is divided at the narrowed region into the upper and lower subparts(FIG. 2(*e*)). At this time, the oxide film has a thickness of 3000 Å. After etching off the silicon nitride film 8 and the upper silicon subpart, an annular groove with an outer diameter of 12000 Å and an inner diameter of 8000 Å is formed(FIG. 2(*f*)). After filling the annular groove with an HTO film 7, a silicon nitride film 4 and a gate film 3 are formed. Then, a silicon oxide film with a thickness of 6000 Å is formed and reflowed(FIG. 2(*g*)) to form a silicon-oxide reflow film 9. Reflow makes the silicon oxide film above an emitter region thinner. The silicon oxide reflow film 9 is dry-etched to expose the gate film 3 above the emitter region. Finally, the gate film 3 and the silicon nitride film 8 are dry-etched and the silicon oxide film 2 is wet-etched to expose the emitter tip and the groove in the oxide film(FIG. 2(*j*)).

In the cold cathode thus formed which has the structure shown in FIG. 2(*j*), there is formed a step 12 due to a difference in an etching rate between the first insulating film(the silicon oxide film) and the second insulating film (the HTO film) during wet-etching. The cathode, therefore, has a structure eliminating current leak due to adhesion of a conductive film to the insulating film.

What is claimed is:

1. A micro cold cathode comprising:

a substrate having at least one conductive surface;

an insulating film formed on the conductive surface;

a conductive gate formed on the insulating film;

an opening extending to the substrate through the insulating film and the conductive gate film;

an emitter electrode formed on the conductive surface in the opening; and a shield member which spatially shields at least part of the insulating film from metal particles emitted from the emitter electrode during voltage application, wherein said shield member is spaced apart from the conductive gate and the emitter electrode, and wherein said at least part of said insulating film that is shielded by said shielding member is exposed to space in said opening.

2. The micro cold cathode as is claimed in claim 1, wherein the shield member comprises an insulator.

3. The micro cold cathode as is claimed in claim 1, wherein the shield member is a wall formed between the emitter electrode and the insulating film.

4. A micro cold cathode comprising:

a substrate having at least one conductive surface;

an insulating film formed on the conductive surface;

a conductive gate formed on the insulating film;

an opening extending through the insulating film and the conductive gate film;

an emitter electrode formed on the conductive surface in the opening; and a shield member which spatially shields at least part of the insulating film from the emitter electrode, wherein said shield member is directly formed on a side surface of the emitter electrode, confined within the opening, and wherein said at least part of said insulating film that is shielded by said shielding member is exposed to space in said opening.

5. The micro cold cathode as is claimed in claim 4, wherein the shield member comprises an insulator.

6. The micro cold cathode as is claimed in claim 4, wherein the shield member is a step formed between the emitter electrode and the insulating film.

* * * * *